US012630950B2

(12) United States Patent
Sekiyama et al.

(10) Patent No.: US 12,630,950 B2
(45) Date of Patent: May 19, 2026

(54) WOVEN FABRIC AND SLIDING MATERIAL

(71) Applicant: Toray Industries, Inc., Tokyo (JP)

(72) Inventors: Masato Sekiyama, Otsu (JP); Yuki Ninomiya, Otsu (JP); Masaru Harada, Otsu (JP)

(73) Assignee: Toray Industries, Inc., Tokyo (JP)

( * ) Notice: Subject to any disclaimer, the term of this patent is extended or adjusted under 35 U.S.C. 154(b) by 219 days.

(21) Appl. No.: 18/281,633

(22) PCT Filed: Mar. 17, 2022

(86) PCT No.: PCT/JP2022/012320
§ 371 (c)(1),
(2) Date: Feb. 21, 2024

(87) PCT Pub. No.: WO2022/209961
PCT Pub. Date: Oct. 6, 2022

(65) Prior Publication Data

US 2025/0327222 A1 Oct. 23, 2025

(30) Foreign Application Priority Data

Mar. 29, 2021 (JP) ..... 2021-055091

(51) Int. Cl.
*D03D 15/47* (2021.01)
*D03D 11/00* (2006.01)
*D03D 15/283* (2021.01)
*D03D 15/30* (2021.01)

(52) U.S. Cl.
CPC ..... *D03D 15/47* (2021.01); *D03D 11/00* (2013.01); *D03D 15/283* (2021.01); *D03D 15/30* (2021.01); *D10B 2321/042* (2013.01); *D10B 2331/021* (2013.01); *D10B 2401/00* (2013.01)

(58) Field of Classification Search
CPC ..... D03D 15/47; D03D 11/00; D03D 15/283; D03D 15/30; D10B 2321/042; D10B 2331/021; D10B 2401/00
See application file for complete search history.

(56) References Cited

U.S. PATENT DOCUMENTS 4,923,741 A * 5/1990 Kosmo ..... A62D 5/00 428/458
4,997,067 A * 3/1991 Watts ..... F16D 65/127 188/77 R
5,736,474 A * 4/1998 Thomas ..... B32B 5/024 442/388
6,132,866 A * 10/2000 Nelson ..... F16C 33/121 428/377
7,033,663 B1 * 4/2006 Hidayetoglu ..... F16D 69/02 523/156
10,302,130 B2 * 5/2019 Zhang ..... D06M 17/04
2003/0022583 A1 * 1/2003 Thomas ..... B32B 5/24 442/403
2007/0223850 A1 * 9/2007 Lopes ..... F16C 33/201 384/192
2013/0273343 A1 * 10/2013 Dolan ..... F41H 5/0485 428/221
2018/0223903 A1 8/2018 Zhang et al.
2019/0040593 A1 * 2/2019 Tetrault ..... B32B 27/12
2019/0242037 A1 * 8/2019 Cao ..... D03D 15/58
2022/0145655 A1 * 5/2022 Yamazaki ..... D03D 13/004
2023/0027891 A1 1/2023 Sekiyama et al.

FOREIGN PATENT DOCUMENTS

CN 108070940 A 5/2018
CN 111005237 A 4/2020
JP 2005220487 A 8/2005
JP 2007255712 A 10/2007
JP 2018525542 A 9/2018
JP 2018178275 A 11/2018
JP 2020-105639 A 7/2020
JP 6762413 B1 9/2020
WO 2017020821 A1 2/2017
WO 2018074207 A1 4/2018
WO 2021124687 A1 6/2021

OTHER PUBLICATIONS

International Search Report and Written Opinion for International Application No. PCT/JP2022/012320, dated May 24, 2022, 6 pages.
Extended European Search Report issued Feb. 28, 2025, by the European Patent Office in corresponding European Patent Application No. 22780180.0-1017. (7 pages).
Office Action (Notification for the Opinion of Examination) issued Mar. 20, 2025, by the Taiwan Intellectual Property Office, Ministry of Economic Affairs in corresponding Taiwanese Patent Application No. 111111031 and an English translation of the Office Action. (7 pages).
Office Action (The First Office Action) issued Nov. 3, 2025, by the State Intellectual Property Office of People's Republic of China in corresponding Chinese Patent Application No. 202280022018.4 and an English translation of the Office Action. (11 pages).

* cited by examiner

*Primary Examiner* — Robert H Muromoto, Jr.
(74) *Attorney, Agent, or Firm* — Buchanan Ingersoll & Rooney PC

(57) ABSTRACT

There is provided a woven fabric that can suppress a thickness reduction due to abrasion even under high-load and high-speed sliding conditions, has an excellent tribological property when used as a sliding material, hardly causes play between members, and can be used by being bonded to the base material; and also provided a woven fabric and a sliding material in which at least one of warp yarns and weft yarns includes doubled and twisted yarns of fluororesin fibers and para-aramid fibers, and the roughness on at least one surface where the doubled and twisted yarns are exposed is 1150 μm or less.

11 Claims, No Drawings

WOVEN FABRIC AND SLIDING MATERIAL

CROSS REFERENCE TO RELATED APPLICATIONS

This is the U.S. National Phase application of PCT/JP2022/012320, filed Mar. 17, 2022, which claims priority to Japanese Patent Application No. 2021-055091, filed Mar. 29, 2021, the disclosures of each of these applications being incorporated herein by reference in their entireties for all purposes.

FIELD OF THE INVENTION

The present invention relates to a woven fabric and a sliding material.

BACKGROUND OF THE INVENTION

Conventionally, a technique has been developed to utilize low friction coefficients of fluororesin to form the fluororesin into fibers and further into woven or knitted fabrics or nonwoven fabrics, and then such fabrics are interposed between sliding members to impart a low friction property between the members. In a case where a thickness of a sliding fabric is greatly reduced due to abrasion, clearances around members related to sliding change, and play of the members occurs. Therefore, in addition to the low friction property and sliding durability, the sliding fabric is also required not to cause a significant thickness reduction due to abrasion even under severe sliding conditions.

Furthermore, since fluororesin generally has a poor adhesiveness, in a case where a sliding material is attached to a base material to impart a tribological property, it is important to secure the adhesiveness in addition to the low friction property and sliding durability of the sliding material alone.

As a technique for imparting the low friction property to the sliding fabric, for example, Patent Document 1 discloses a self-lubrication fabric including a composite yarn formed from fluororesin fibers and other fibers, in which a ratio of surface area of the other fibers on one side surface of the fabric to a surface area of the entire composite yarn is 0 to 30%.

As a technique for suppressing the play between members when used as the sliding material, for example, Patent Document 2 discloses a fabric in which fluororesin fibers and the other fibers are alternately arranged, and an amount of compression of the fabric is 25 μm or less.

PATENT DOCUMENTS

Patent Document 1: WO 2017/020821 A
Patent Document 2: WO 2018/074207 A

SUMMARY OF THE INVENTION

However, the woven fabric described in Patent Document 1 has a high proportion of fluororesin fibers in the composite yarn, and when exposed to high-speed sliding under a high load, discharge of abrasion powder of fluororesin yarns cannot be sufficiently suppressed, resulting in room for improvement in suppressing the thickness reduction due to abrasion. Further, due to the high proportion of the fluororesin fibers, in a case where fibers with a low thermal shrinkage ratio such as para-aramid fibers are selected as other yarns, there is a problem that after heat treatment, roughness increases due to a difference in thermal shrinkage from the fluororesin fibers, and the adhesiveness and the tribological property deteriorate.

The woven fabric described in Patent Document 2 can suppress the play between members because the amount of compression in a thickness direction is small when a load is applied, but there is still room for improvement in the thickness reduction after sliding under the high load and with a high speed.

Furthermore, although the tribological property has been studied in any of the above patent documents, specific influence on the adhesiveness has not been disclosed, and in a case where fibers with the low thermal shrinkage ratio such as the para-aramid fibers are selected as the other yarns for a purpose of improving durability, the roughness after heat treatment may be increased due to a thermal shrinkage difference with the fluororesin fibers, and the adhesiveness may be deteriorated, so there is room for further study in development of the sliding material with both the tribological property and the adhesiveness.

Therefore, one object of the present invention is to provide a woven fabric that combines the low friction property, the sliding durability, and the adhesiveness, as well as can suppress the thickness reduction due to abrasion even under high-load and high-speed sliding conditions.

By using the woven fabric of the present invention as the sliding material, one object of the present invention is to provide a woven fabric that is excellent in tribological property, can function as the sliding material for a long period of time, can suppress the play between members, and can be used by being adhered to the base material.

In order to solve the above problems, the present invention is configured as follows.

A woven fabric according to various embodiments including doubled and twisted yarns of fluororesin fibers and para-aramid fibers for at least one of warp yarns and weft yarns, having a roughness of 1150 μm or less on at least one surface where the doubled and twisted yarns are exposed.

The woven fabric with a thickness of 1.3 mm or less.

The woven fabric wherein the warp yarns and the weft yarns include the doubled and twisted yarns.

The woven fabric wherein the woven fabric is a multilayer woven fabric including a first surface that is an outermost surface and a second surface that is an outermost surface opposite to the first surface, and at least one of the warp yarns and the weft yarns of the first surface includes the doubled and twisted yarns.

The woven fabric wherein a ratio (CF1/CF2) of a cover factor (CF1) of the first surface to a cover factor (CF2) of the second surface is less than 1.

The woven fabric wherein a mass ratio of the fluororesin fibers in the entire woven fabric is 20 mass % or less.

A sliding material including the woven fabric.

The sliding material including at least one surface, as a sliding surface, on which the doubled and twisted yarns are exposed and a roughness is 1150 μm or less.

The present invention provides a woven fabric and a sliding material with a low friction property, a sliding durability, and an adhesiveness. As the woven fabric and the sliding material are capable of suppressing a thickness reduction due to abrasion even under high-load and high-speed sliding conditions, when used as a sliding material, the woven fabric and the sliding material are excellent in tribological property and can function as a sliding material for a long period of time, suppressing the play between members and being usable after being adhered to the base material.

DETAILED DESCRIPTION OF EMBODIMENTS OF THE INVENTION

The woven fabric according to embodiments of the present invention includes the doubled and twisted yarns of fluororesin fibers and para-aramid fibers in at least one of the warp yarns and the weft yarns.

Other than the method of forming the doubled and twisted yarns, composite forms of fluororesin fibers and para-aramid fibers, for example, a structure using the fluororesin fibers for warp yarns (or weft yarns) and the para-aramid fibers for weft yarns (or warp yarns), a structure in which the fluororesin fibers and the para-aramid fibers are alternately arranged for the warp yarns and the weft yarns and a double woven fabric in which a fluororesin fiber layer and a para-aramid fiber layer are completely separated, can be considered. However, in a configuration in which the fluororesin fibers are used as the warp yarns (or the weft yarns) and the para-aramid fibers are used as the weft yarns (or the warp yarns), or in a configuration in which the fluororesin fibers and the para-aramid fibers are alternately arranged, fluorofibers are likely to be broken early at a portion where the fluororesin fibers with a low strength are localized (for example, a portion where the fluororesin fibers used as the warp yarns (or the weft yarns) are continuously arranged, or an intersecting point between the fluororesin fibers used as the warp yarns and the fluororesin fibers used as the weft yarns), and it is possible that the portion becomes a starting point of fabric breakage. Therefore, in a case where extremely excellent sliding durability under the high load and with the high speed is required, it is difficult to obtain satisfactory performance. In a case where the double woven fabric in which the fluororesin fiber layer and the para-aramid fiber layer are completely separated is formed, the fluororesin fiber layer abrades along with sliding, making it difficult to suppress the thickness reduction.

On the other hand, when the fluororesin fibers and the para-aramid fibers are integrated before being woven as the doubled and twisted yarns and arranged in the woven fabric, the fluororesin fibers and the para-aramid fibers become adjacent to each other, and fluorine abrasion powder generated by sliding is then easily transferred to the para-aramid fibers to form a self-lubrication film, thus helping achieve an excellent abrasion durability under the high load.

Further, examples of the forms in which the fluororesin fibers and the para-aramid fibers are integrated before weaving include, in addition to the doubled and twisted yarns in which the fluororesin fibers and the para-aramid fibers are doubled and twisted, covering yarns in which the para-aramid fibers are used as core yarns and the fluororesin fibers are wound around the core yarns as sheath yarns, and blending spun yarns formed by short fibers of the fluororesin fibers and short fibers of the para-aramid fibers. However, in the covering yarns, since the fluororesin fibers are unevenly distributed on a sheath side, soft fluororesin fibers will be selectively abraded during sliding, and the thickness reduction tends to be remarkable. In the blending spun yarns, it is difficult to obtain sufficient entanglement between the fluororesin fibers and the para-aramid fibers due to the low friction property of the fluororesin fibers, and it is also difficult to obtain sufficient durability during sliding.

On the other hand, in the doubled and twisted yarns, while the para-aramid fibers serve as an aggregate to maintain strength and suppress abrasion, surrounding fluororesin fibers are likely to be transferred to the para-aramid fibers as the abrasion powder, and suppression of thickness reduction is achieved along with excellent low friction property and sliding durability.

In the doubled and twisted yarns including the fluororesin fibers and the para-aramid fibers, the number of twists (the number of upper twists), that is, a twist coefficient k, during doubling and twisting is preferably 1000 or more and 25000 or less. The twist coefficient k is more preferably 1000 or more and 10000 or less, particularly preferably 2000 or more and 7000 or less.

Here, the twist coefficient k is determined by the following formula, where the number of twists per 1 m is denoted by T [t/m], with D [dtex] being a fineness of the doubled and twisted yarns.

$$k = T \times D^{0.5}$$

The doubled and twisted yarns including the fluororesin fibers and the para-aramid fibers is preferably a twisted yarn of the fluororesin fibers or the para-aramid fibers before being doubled and twisted. Since an opening of the para-aramid fibers due to abrasion during weaving can be suppressed by yarn twisting, a phenomenon can be thus prevented, in which the fluororesin fibers in the doubled and twisted yarns can be covered by the para-aramid fibers opened, thereby disturbing the low friction property. In this case, the twist coefficient of the para-aramid fibers before the doubling and twisting is preferably 500 or more and 5000 or less. Furthermore, when the twist coefficient is 500 or more and 3000 or less, in addition to the above effects, the yarn twisting improves the strength of the para-aramid fibers to make the para-aramid fibers more firmly present as a skeletal yarn in the woven fabric, thus improving the sliding durability. The twist coefficient is particularly preferably 900 or more and 3000 or less. If the twist coefficient of the para-aramid fibers is more than 5000, the strength may be lower than that before the yarn twisting. When the para-aramid fibers are subjected to the yarn twisting, a step of simply applying twisting to raw yarns with a desired fineness may be employed, or a step of twisting together yarns with a fineness smaller than the desired fineness may be employed. For example, in preparing the para-aramid fibers with a twist number of 33 [t/m] and a fineness of 850 [dtex], the raw yarns for the para-aramid fibers with a fineness of 850 [dtex] may be subjected to the yarn twisting for 33 [t/m], or two raw yarns for the para-aramid fibers with a fineness of 425 [dtex] may be subjected to doubling and twisting for 33 [t/m].

A yarn length difference of the doubled and twisted yarns including the fluororesin fibers and the para-aramid fibers may be adjusted in accordance with the thermal shrinkage difference between the fluororesin fibers and the para-aramid fibers at a maximum temperature exposed in processing steps and in use. For example, in a case where the maximum temperature exposed in the processing steps and in use is 200° C. and the thermal shrinkage difference between the fluororesin fibers and the para-aramid fibers at that temperature is 10%, the yarn length of the fluororesin fibers may be made 10% longer than that of the para-aramid fibers during doubling and twisting. By adopting such a mode, development of roughness due to the thermal shrinkage difference can be suppressed, and the effect of the present invention can be easily obtained.

In the woven fabric according to embodiments of the present invention, the doubled and twisted yarns of the fluororesin fibers and the para-aramid fibers is included in at least one of the warp yarns and the weft yarns, and is preferably included in both the warp yarns and the weft yarns. In addition, interweaving with the other fibers is also possible.

In embodiments of the present invention, it has been found that by selecting the para-aramid fibers as a weaving counter material of the fluororesin fibers, the thickness reduction can be remarkably suppressed as compared with the case of using the other fibers such as PPS fibers, meta-aramid fibers, and liquid crystal polyester fibers. In a case where the woven fabric using fibers other than the para-aramid fibers as high-strength fibers is used as the sliding material, for example, by arranging a large number of the fluororesin fibers on the sliding surface via devising a woven structure or the like and arranging a large number of high-strength fibers as the aggregate on an opposite side of the sliding surface, it is possible to optimize a balance between the low friction property and the sliding durability. However, since an abrasion speed of a region including a large number of the fluororesin fibers at the initial sliding stage is increased, it is difficult to achieve both the sliding durability and the suppression of a thickness change due to abrasion.

On the other hand, when the para-aramid fibers are doubled and twisted with the fluororesin fibers as in embodiments of the present invention, the para-aramid fibers exert an extremely high skeletal effect, and it is possible to obtain a woven fabric that provides a sliding material achieving not only sliding durability but also capable of suppressing thickness change due to abrasion. Furthermore, the para-aramid fibers are also excellent in processability, and can be produced as a woven fabric suitable for a thin sliding material inexpensively and easily as compared with inorganic fibers such as carbon fibers. Furthermore, fluffing due to abrasion, which is a problem to be solved with inorganic fibers, can be suppressed. Therefore, even in a case where the woven fabric is used alone, for example, by attaching the sliding material to a structure instead of being a composite material in which the woven fabric is impregnated with resin, it is possible to prevent impurities such as fluffs from being mixed into the yarns of the structure.

The woven fabric according to embodiments of the present invention has a roughness of 1150 μm or less on at least one side surface where the doubled and twisted yarns are exposed. Further, a roughness "on at least one side surface where the doubled and twisted yarns are exposed" satisfying the above range means that the roughness of the exposed side surface in a case where the doubled and twisted yarns are exposed only on one side surface, or of the more exposed side surface in a case where the doubled and twisted yarns are exposed on both side surfaces, or of either one side surface in a case where the doubled and twisted yarns are equally exposed, may satisfy the above range.

Since the fluororesin fibers have a larger thermal shrinkage than that of the para-aramid fibers, after wet heat treatment and dry heat treatment, a portion where a relatively large number of the para-aramid fibers is present becomes convex due to the shrinkage difference, and a portion where a relatively large number of the fluororesin fibers are present becomes concave, resulting in a possible roughness. When the roughness is generated in this manner, a convex portion containing a large number of the para-aramid fibers is likely to selectively come into contact with a counter material at the initial sliding stage. When the roughness increases by a certain amount or more, depending on a surface roughness of the counter material, physical interactions such as catching between the convex portion and the counter material may increase, causing the friction coefficient to rise. Furthermore, in this case, since stress is concentrated on the convex portion, the abrasion speed tends to be high. Furthermore, when the roughness is too large, a concave portion can not be impregnated with an adhesive when a bonding processing is performed, which reduces a net bonding area and further makes it difficult to obtain a sufficient adhesiveness. In a case where an adhesive coating amount is increased or a clamping pressure is increased in order to obtain the bonding area, an adhesive impregnation amount of the convex portion is excessively increased as compared with the periphery, or the adhesive will penetrate the sliding surface, causing the tribological property to deteriorate. From the above viewpoint, the roughness is 1150 μm or less. The roughness is more preferably 1000 μm or less, and still more preferably 800 μm or less. The roughness is particularly preferably 500 μm or less. A substantial lower limit of the roughness is 0 μm.

The mass ratio of the fluororesin fibers in the doubled and twisted yarns according to embodiments of the present invention is preferably 3 to 97 mass %. If the mass ratio of the fluororesin fibers in the doubled and twisted yarns is more than 97 mass %, the number of the para-aramid fibers capable of capturing the abrasion powder as the aggregate is too small with respect to the amount of generated fluororesin abrasion powder, making it difficult to suppress the thickness change. The mass ratio of the fluororesin fibers in the doubled and twisted yarns is more preferably 80 mass % or less, and still more preferably 60 mass % or less. When the mass ratio of the fluororesin fibers in the doubled and twisted yarns is less than 3 mass %, the amount of the fluororesin abrasion powder transferred to the para-aramid fibers is too small, making it impossible to obtain a sufficiently low friction property. The mass ratio of the fluororesin fibers in the doubled and twisted yarns is preferably 20 mass % or more, more preferably 40 mass % or more.

The thickness of the woven fabric of the present invention is preferably 1.3 mm or less. By using the doubled and twisted yarns of the fluororesin fibers and the para-aramid fibers for at least one of the warp yarns and the weft yarns, a thickness reduction speed of the woven fabric is remarkably reduced even under high-load and high-speed sliding, thus allowing a sufficient sliding durability to be obtained even with a small thickness. Reasons for the thickness reduction of the woven fabric include fibers being discharged to outside of the yarns due to abrasion and breakage and a change into a close-packed structure when gaps between single yarns are filled by pressurization or sliding. The thickness reduction caused by the latter increases as an absolute amount of voids present in the woven fabric increases. In other words, the smaller the thickness of the woven fabric is, the more the thickness reduction can be suppressed. Among them, the thickness is preferably 1.2 mm or less, more preferably 0.8 mm or less, still more preferably 0.5 mm or less, and particularly preferably 0.3 mm or less. If the thickness is too small, it is difficult to obtain a desired abrasion durability, and thus the thickness is preferably 0.05 mm or more, more preferably 0.1 mm or more, and particularly preferably 0.2 mm or more.

Woven structures of the woven fabric of the present invention are not particularly limited, and can adopt a twill structure, a satin structure, a flat structure, or a modified structure thereof. Among them, the flat structure is preferable because the thickness can be relatively easily reduced, and the thickness reduction due to sliding can be easily suppressed.

In the woven fabric according to embodiments of the present invention, multilayer structures such as a single-layer structure and a double-layer structure can be selected according to required properties. In a case of the single-layer structure, the thickness can be relatively easily reduced, and the thickness reduction due to sliding can be easily suppressed. In a case of forming the multilayer woven fabric with the multilayer structure such as the double-layer structure, when one surface that is an outermost surface is defined as a first surface and an outermost surface on a side surface opposite to the first surface is defined as a second surface, it is preferable that at least one of the warp yarns and the weft yarns of the first surface includes the doubled and twisted yarns. Then in a case where the multilayer woven fabric is used as the sliding material, the first surface may preferably be the sliding surface. In a case where only the first surface that is one side surface of the multilayer woven fabric is used as the sliding surface in the sliding material, the second surface is the opposite side of sliding surface. In the multilayer woven fabric, the fibers to be used in a layer including the opposite side of sliding surface can be appropriately selected according to purposes, but by using the para-aramid fibers, both the sliding durability and the adhesiveness may be easily achieved. In terms of thickness, a double-layer woven fabric is preferable. In a case of the double-layer structure, a sufficient thickness can be maintained for a long time even though the thickness is reduced by sliding, and the sliding durability is easily improved. In a case where the double-layer structure is used as a double-layer woven fabric including the first surface and the second surface, it is preferable that at least one of the warp yarns and the weft yarns of the first surface includes the doubled and twisted yarns of the fluororesin fibers and the para-aramid fibers, and it is more preferable that both the warp yarns and the weft yarns of the first surface include the doubled and twisted yarns of the fluororesin fibers and the para-aramid fibers.

In a case where the double-layer structure is selected, the ratio (CF1/CF2) of the cover factor (CF1) of the first surface to the cover factor (CF2) of the second surface is preferably smaller than 1. The cover factor here refers to a factor determined by the following formula.

$$\text{Cover factor} = (\text{total fitness of warp yarns } [dtex])^{0.5} \times \text{warp yarns' density } [\text{yarns}/2.54\text{ cm}] + (\text{total fineness of weft yarns } [dtex])^{0.5} \times \text{weft yarns' density } [\text{yarns}/2.54\text{ cm}]$$

Further, a total fineness in calculating the cover factor is converted by a specific gravity of a fiber type. The present technique provides the woven fabric including the fluororesin fibers and the para-aramid fibers, and in a case where polytetrafluoroethylene fibers are taken as an example of the fluororesin fibers, the specific gravity thereof is 2.3 and is larger than 1.4, the specific gravity of the para-aramid fibers. Therefore, in a case of the same fineness, the para-aramid fibers have a larger actual fiber diameter. Therefore, the fineness of the fluororesin fibers is converted based on the para-aramid fibers to reflect the actual fiber diameter and calculate the cover factor. In other words, based on the specific gravity (1.4) of the para-aramid fibers, a fineness T after conversion to the used raw yarns with a specific gravity D and a fineness $T_0$ is converted according to the following formula.

$$T = T_0 \times 1.4/D$$

For example, the total fineness T of the doubled and twisted yarns including fluororesin fibers of 440 dtex with a specific gravity of 2.3 and para-aramid fibers of 800 dtex is determined by the following formula.

$$T = 440 \times 1.4/2.3 + 800 = 1067$$

By setting the ratio (CF1/CF2) of the cover factor (CF1) of the first surface to the cover factor (CF2) of the second surface to be less than 1, the roughness of the first surface (when used as the sliding material, in a case where the first surface is the sliding surface and the second surface is a bonding surface, the first surface becomes the sliding surface (a non-bonding surface)) can be reduced.

As described above, the roughness of the woven fabric tends to increase as the thermal shrinkage difference between the fluororesin fibers and the para-aramid fibers increases. The yarn length difference caused by the thermal shrinkage is restrained at the intersecting point between the warp yarns and the weft yarns, and a portion with a long yarn length is made convex, and a portion with a short yarn length is made concave, thus generating roughness. With a large cover factor, that is, when the fineness is large or the density is high, there is a small number of voids to absorb the yarn length difference caused by the thermal shrinkage, thus leading to an increased roughness. On the other hand, with a small cover factor, the warp yarns and the weft yarns are weakly restrained and a fabric structure can be difficultly maintained in a case of being slid, causing the sliding durability to deteriorate. Therefore, when the layer including the first surface has a structure with a low cover factor and the layer including the second surface has a structure with a high cover factor, a long-term sliding durability can be obtained by suppressing the roughness of the first surface while maintaining the fabric structure on the second surface. Further, with the low cover factor of the first surface, the number of voids increases, and a portion where fibers are present may become convex, while a void portion may become concave, possibly resulting in roughness. In this case, with sufficient voids, the fiber s spread flat, and the warp yarns as well as the weft yarns are pushed and spread by the weft yarns and the warp yarns that are interlaced with each other. The roughness due to the voids generated from the low cover factor is smaller than the roughness due to the thermal shrinkage difference.

From the above viewpoint, in a case where the double-layer structure is selected, the ratio (CF1/CF2) of the cover factor (CF1) of the first surface to the cover factor (CF2) of the second surface is preferably smaller than 1, and more preferably smaller than 0.8. In a case where the cover factor (CF2) of the second surface is too large, a weaving performance is deteriorated, and in a case where the cover factor (CF1) of the first surface is too small, the number of intersecting points with respect to the thickness of the yarn becomes excessively small, and only constituent fibers of the first surface are easily frayed by sliding. Therefore, CF1/CF2 is preferably larger than 0.2, and more preferably larger than 0.4.

When selecting the multilayer woven fabric with the multilayer structure such as the double-layer structure, it is preferable to select the para-aramid fibers as knot yarns. The knot yarns as used herein refer to yarns that join two layers and constitute the multiple structure such as the double-layer structure. For example, in a case where the warp yarns of the first surface are regarded as the knot yarns, the knot yarns include a normal portion forming the first surface and a knot portion entangled with the weft yarns of the second surface. In the knot portion, the yarn goes around more than in the normal portion, and the yarn becomes tighter than in the normal portion. When the doubled and twisted yarns of the fluororesin fibers and the para-aramid fibers or the fluororesin fibers are used for the knot portion, a tightness of the knot portion is further increased due to the thermal shrinkage when heat is applied, and entangled weft yarns are easily pushed up to form the convex portion. From the above, it is preferable to select the para-aramid fibers with the low thermal shrinkage ratio as the knot yarns.

In the woven fabric according to embodiments of the present invention, the mass ratio of the fluororesin fibers to the entire woven fabric is not particularly limited, but in a case where the mass ratio of the fluororesin fibers to the entire woven fabric is 20 mass % or less, the roughness can be preferably reduced even in a case where heat treatment is included in the process. By reducing the mass ratio of the fluororesin fibers with relatively large thermal shrinkage as compared to the para-aramid fibers, the development of roughness due to a difference in shrinkage after heat treatment can be suppressed. In a case of a composite other than the fluororesin fibers and the para-aramid fibers, an increase in friction coefficient and a decrease in durability associated therewith occur due to a decrease in the fluororesin fibers, but an extremely high skeletal effect is exhibited by selecting the para-aramid fibers, and an excellent tribological property can be exhibited even in a case where the mass ratio of the fluororesin fibers is relatively low. From a viewpoint of reducing the roughness, the mass ratio of the fluororesin fibers in the entire woven fabric is preferably 20 mass % or less, more preferably 15 mass % or less, and particularly preferably 10 mass % or less. The mass ratio of the fluororesin fibers is preferably 1 mass % or more, more preferably 3 mass % or more, and particularly preferably 5 mass % or more.

In embodiments of the present invention, the fluororesin that is a component of the fluororesin fibers should be configured to include monomer units containing one or more fluorine atoms in a main chain or a side chain. Among them, those including monomer units with a large number of fluorine atoms are preferable.

The monomer units containing one or more fluorine atoms are contained in an amount of preferably 70 mol % or more, more preferably 90 mol % or more, and still more preferably 95 mol % or more in repeating structural units of a polymer.

Examples of the monomers containing one or more fluorine atoms include fluorine atom-containing vinyl monomers such as tetrafluoroethylene, hexafluoropropylene, and chlorotrifluoroethylene, among which it is preferable to use at least tetrafluoroethylene.

The fluororesin can be used alone or in combination with two or more types of, for example, polytetrafluoroethylene (PTFE), tetrafluoroethylene-hexafluoropropylene copolymer (FEP), tetrafluoroethylene-p-fluoroalkyl vinyl ether copolymer (PFA), polychlorotrifluoroethylene (PCTFE), and ethylene-tetrafluoroethylene copolymer (ETFE).

The fluororesin including a tetrafluoroethylene unit preferably has a larger content of the tetrafluoroethylene unit in terms of sliding characteristics and is preferably a copolymer containing, of a total, 90 mol % or more, and preferably 95 mol % or more of tetrafluoroethylene, and it is the most preferable to use polytetrafluoroethylene fibers as a homopolymer of tetrafluoroethylene.

As the form of the fluororesin fibers used in embodiments of the present invention, both a monofilament formed of one filament and a multifilament formed of a plurality of filaments can be used, but the multifilament is preferable from a viewpoint of the weaving performance and the roughness on the surface of the fabric into which the fibers are formed.

In addition, the fluororesin fibers used in embodiments of the present invention preferably have a total fitness in a range of 50 to 6000 dtex. The total fineness more preferably falls within a range of 500 to 5500 dtex, and still more preferably within a range of 400 to 1500 dtex. When the total fineness of the fibers constituting the fabric is 50 dtex or more, the strength of the fibers can be secured to a certain extent, breakages of yarns during weaving can be also reduced, and a process passability can be thus improved. When the total fineness is 6000 dtex or less, favorable processability during weaving is obtained.

For the fluororesin fibers used in embodiments of the present invention, a smaller dry thermal shrinkage ratio is preferable, because with a smaller thermal shrinkage difference between the fluororesin fibers and the para-aramid fibers, the development of roughness after heating can be suppressed. From such a viewpoint, the dry thermal shrinkage ratio is preferably 15% or less, more preferably 10% or less, and particularly preferably 5% or less. The substantial lower limit of the dry thermal shrinkage rate is 0%. The dry thermal shrinkage ratio of the fluororesin fibers can be appropriately controlled by a method commonly used in the art, such as an oxidation treatment or a heat treatment after drawing. The dry thermal shrinkage rate is a value measured by a method to be described later.

The form of the para-aramid fibers constituting the woven fabric according to embodiments of the present invention is not particularly limited, and either a filament (a long fiber) or a short fiber (a spun yarn) can be applied, but the para-aramid fiber are preferably filaments from viewpoints of tensile strength and tensile stiffness. Furthermore, both a monofilament formed of one filament and one multifilament formed of a plurality of filaments can be used, but the multifilament is particularly preferable because the multifilament has a large surface area, and thus the fluorine abrasion powder generated by abrasion of the fluororesin fibers A is likely to be transferred to the fibers B.

The para-aramid fibers preferably have a total fineness in the range of 50 to 4000 dtex. It is more preferably in the range of 200 to 4000 dtex, and still more preferably in the range of 800 to 3300 dtex. When the fibers constituting the fabric have a total fineness of 200 dtex or more, the strength of the fibers is strong, fiber fracture during abrasion can be suppressed and also yarn breakage during weaving can be reduced, so that the process passability is improved. The fibers with a total fineness of 3300 dtex or less enables the fabrics to have a small roughness on the surface thereof and to reduce the influence on a low frictional property.

As described above, since the roughness of the woven fabric is easily affected by shrinkage behavior of the fluororesin fibers and a para-aramid, temperature and humidity are controlled to enable the roughness to fall within a range specified in embodiments of the present invention in post-processing after weaving. A post-processing method is not limited as long as the obtained woven fabric falls within the range specified in embodiments of the present invention. Based on heat history in the post-processing, it is preferable to select a method in which heat treatment is not performed or to suppress heat treatment conditions to set the roughness within the range specified in embodiments of the present invention. Specifically, the development of roughness can be controlled by relaxing the heat treatment conditions via methods such as lowering the temperature of the wet heat treatment and the dry heat treatment, shortening the heating time, or using either the wet heat treatment or the dry heat treatment. In a woven fabric design for obtaining a desired woven fabric, post-treatment conditions may be determined in view of the above to ensure that the roughness falls within the range defined in embodiments of the present invention.

The wet heat treatment as used herein refers to a scouring step, a relaxing step, a dyeing step, and the like performed for a purpose of washing the woven fabric and removing a residual stress. By adopting such a treatment, the development of roughness caused by the thermal shrinkage difference between the fluororesin fibers and the para-aramid fibers can be suppressed. Further, it is preferable not to perform sizing during weaving because attention is required for conditions such as washing and scouring of the woven fabric.

The dry heat treatment herein refers to a drying step following each of the scouring step, the relaxing step, and the dyeing step mentioned above, a thermosetting step, or a drying step after coating to be described later. By paying attention as described above, the development of roughness caused by the thermal shrinkage difference between the fluororesin fibers and the para-aramid fibers can be suppressed.

In order to further enhance the abrasion durability of the woven fabric, it is also possible to use the woven fabric that has been coated with resin. Here, as the resin to be used, a thermosetting resin or a thermoplastic resin can be used. The resin is not especially limited, and examples of the thermosetting resin include a phenolic resin, a melamine resin, a urea resin, an unsaturated polyester resin, an epoxy resin, a polyurethane resin, a diallyl phthalate resin, a silicon resin, a polyimide resin, a vinyl ester resin, and modified resins thereof; examples of the thermoplastic resin that can be preferably used include a vinyl chloride resin, a polystyrene resin, an ABS resin, a polyethylene resin, a polypropylene resin, a fluororesin, a polyamide resin, a polyacetal resin, a polycarbonate resin, a polyester resin and an acrylic resin; and further synthetic rubbers or elastomers such as a thermoplastic polyurethane, a butadiene rubber, a nitrile rubber, a neoprene, and a polyester elastomer. Among them, a resin containing the phenolic resin and a polyvinyl butyral resin as main components, the unsaturated polyester resin, the vinyl ester resin, a polyolefin-based resin such as the polyethylene and the polypropylene, and the polyester resin can be preferably used, in terms of an impact resistance, a dimensional stability, a strength, costs, and the like. These types of the thermosetting resin and the thermoplastic resin may contain various additive agents that are usually used industrially for a purpose or an application, or in a manufacturing process or a processing process to improve productivity or properties. The resin can contain, for example, a modifier, a plasticizer, a filler, a mold lubricant, a colorant, a diluent, or the like. Further, a main component referred to here means a component with a largest mass ratio among components except a solvent, and the resin containing the phenolic resin and the polyvinyl butyral resin as the main components means that these two types of resin have a first largest and a second largest (no particular order) mass ratios.

As a method for applying the resin to the woven fabric, in a case of a liquid resin, a solvent-based resin, or an aqueous resin, the resin is applied by a method such as spraying, roll coating, knife coating, comma coating, gravure coating, flexographic printing, brush coating, or melt extrusion lamination. In addition, for example, in a case of powdery resin particles, there is a method of applying static electricity for coating. After the applying, it is possible to remove the solvent, thermally cure the fabric, or form a melt film. At this time, heat treatment is performed as necessary. From a viewpoint of reducing the heat treatment temperature and suppressing the roughness, it is preferable to perform a process with a small moisture adhesion amount, and specifically, methods such as spraying, flexographic printing, and brush coating are suitable.

A lubricant or the like can also be added to the woven fabric according to embodiments of the present invention as necessary. The type of the lubricant is not especially limited, but is preferably a silicon-based lubricant or a fluorine-based lubricant material.

Since the woven fabric according to embodiments of the present invention thus obtained is a woven fabric in which the doubled and twisted yarns of fluororesin fibers and para-aramid fibers are used and roughness is suppressed, the woven fabric has a low friction property, sliding durability, and adhesiveness. Therefore, the woven fabric according to embodiments of the present invention not only can exhibit a higher sliding durability than before in applications where it has been difficult to use the woven fabric for a long period of time when the woven fabric is subjected to high-speed and high-load sliding, but also can suppress play, and be easily used by being attached to the base material, thus achieving extremely high industrial practicability as the sliding material. Then, in a case where the woven fabric of the present invention is used as the sliding material, it is preferable that at least one surface on which the doubled and twisted yarns are exposed and the roughness is 1150 μm or less is used as the sliding surface.

EXAMPLES

Hereinafter, embodiments of the present invention will be described together with comparative examples.

Further, methods of measuring various properties in the present examples are as follows.

(1) Fineness

A total fineness of fibers was measured according to Method 8.3.B (a simple method) of JIS L 1013:2010 "Testing methods for man-made filament yarns". Further, in a case where the total fineness of the fibers contained in the woven fabric is measured, disassembled yarns are taken out from the woven fabric and measured. However, in a case where the disassembled yarns fail to secure the amount of yarns required for the measurement method mentioned above, the result of the test carried out with a maximum length that can be secured and the number of trials can be used as a substitute.

(2) Weaving Density

In accordance with 8.6.1 of JIS L1096:2010 "Testing methods for woven and knitted fabrics", a sample was placed on a flat table with unnatural creases and tension removed, the number of warp yarns and weft yarns was counted in a 50-mm space at different locations, and the average values of the warp yarns and the weft yarns were calculated per unit length.

(3) Thickness

A thickness after standing for 10 seconds under 23.5 kPa was measured according to Method 8.4.A of JIS L 1096: 2010 "Testing methods for woven and knitted fabrics".

(4) Roughness

The sample was placed on a flat table with unnatural creases and tension removed, and an area of 25 mm×25 mm was photographed by 3D coupled observation with a digital microscope ("VHX-7000" manufactured by Keyence Corporation). A height difference between two points of the maximum height and the minimum height in this region was defined as the roughness. Further, in a case where the doubled and twisted yarns were exposed only on one surface of the sample, the sample was placed and observed with the surface facing upward. In a case where the doubled and twisted yarns were exposed on both sides, the sample was placed and observed with the more exposed surface facing upward. In a case where the yarns were equally exposed, the sample was placed and observed with any one of the surfaces facing upward. The above measurement was performed at five points of each sample, and an average value of three points excluding a maximum value and a minimum value was calculated.

(5) Kinetic Friction Coefficient

According to Method A of JIS K 7218:1986 "Testing methods for sliding wear resistance of plastics", the woven fabric was sampled to a length of 30 mm and a width of 30 mm, placed on a SUS plate with the same size and a thickness of about 3 mm so that the surface of the SUS plate whose roughness was measured in the above (4) can slide against a ring to be described later, and fixed to a sample holder. The counter material used is made of S45C and has a hollow cylindrical ring shape of 25.6 mm in outer diameter, 20 mm in inner diameter, and 15 mm in length. The surface of the ring was polished with a sandpaper to an adjusted surface roughness of Ra=0.8 μm±0.1. For the measurement of the roughness, a roughness tester ("SJ-210" manufactured by Mitutoyo Corporation) was used. With the use of, as a ring abrasion tester, "MODEL: EFM-III-EN" manufactured by A&D Company, Limited, a test was performed at a friction load of 10 MPa and a friction speed of 400 mm/second to measure a sliding torque, and an average value of friction coefficients until breakage was calculated.

(6) Sliding Durability Distance

In the ring abrasion test, sliding was continued until the woven fabric was broken, and a cumulative sliding distance until breakage was defined as the sliding durability distance.

(7) Thickness Reduction Rate

In the ring abrasion test, the test was stopped one minute after the start of sliding (sliding distance: 24 m), the sample was taken out, a cross section of the sliding portion was cut out, and the cross section was observed using the digital microscope ("VHX-7000" manufactured by Keyence Corporation) to measure a thickness $D_1$ after sliding. Separately, a new sample was prepared and allowed to stand for one minute with a load of 10 MPa applied by the ring abrasion tester, and then the sample was taken out in the same manner as above, and the cross section of the pressurized portion was cut out, and the cross section was observed using the digital microscope ("VHX-7000" manufactured by Keyence Corporation) to measure a thickness $D_0$. A thickness reduction rate D [μm/min] was determined by the following formula.

$$D = D_0 - D_1$$

Further, use a new sample that was of the same type as the sample subjected to the ring abrasion test, and was sampled from a position as close as possible.

(8) Adhesiveness

The test was performed in accordance with JIS K 6850: 1999 "Adhesives-Determination of tensile lap-shear strength of rigid-to-rigid bonded assemblies". The woven fabric was sampled to a length of 100 mm and a width of 25 mm, and a SS 400 plate with a thickness of 15 mm, a length of 100 mm, and a width of 25 mm was prepared as the counter material. An epoxy adhesive ("2088 E" manufactured by ThreeBond Holdings Co., Ltd.) was used as an adhesive. The adhesive was uniformly applied to the SS 400 plate with a coating amount of 150 g/m$^2$ and a lap length of 12.5 mm, then the counter material was superposed on the woven fabric so that a surface opposite to a surface of the woven fabric whose roughness was measured in the above (4) was in contact with the counter material, and the counter material was allowed to stand for 48 hours under a pressure of 16 kPa. The obtained sample was pulled at a tensile speed of 5 mm/min using a tensile tester ("5965" manufactured by Instron Corporation), and a maximum value of the force when the sample was broken was divided by the bonding area to calculate a tensile shear bonding strength.

(9) Mass Ratio of Fluororesin Fibers in Doubled and Twisted Yarns

The woven fabric was cut into warp 200 mm×weft 200 mm, and then the warp yarns and weft yarns were disassembled to obtain disassembled yarns. For each of warp disassembled yarns and weft disassembled yarns, five doubled and twisted yarns were randomly selected from the disassembled yarns obtained and decomposed into fluororesin fibers and para-aramid fibers, and the masses of such fibers were measured. A mass ratio α of the fluororesin fibers in the doubled and twisted yarns was calculated by the following calculation formula with W for a mass sum of the five doubled and twisted yarns and WF for a mass sum of the fluororesin fibers of the five doubled and twisted yarns.

$$\alpha = WF/W \times 100 \text{ [mass\%]}$$

However, in a case where the disassembled yarns fail to secure the amount of yarns required for the measurement method mentioned above, the result of the test carried out with a maximum length that can be secured and the number of trials can be used as a substitute.

(10) Mass Ratio of Fluororesin Fibers to Entire Woven Fabric

The woven fabric was cut into warp 200 mm×weft 200 mm, the warp yarns and the weft yarns were disassembled, and then a total mass W of the disassembled yarns was measured. Subsequently, only the doubled and twisted yarns among the dissembled yarns were selected, and a total mass $W_1$ of the doubled and twisted yarns in the woven fabric was measured. Subsequently, the fluororesin fibers present alone in the woven fabric rather than the doubled and twisted yarns were selected, and a total mass $W_2$ was measured. A mass ratio Y of the fluororesin fibers A in the woven fabric was calculated by the following formula. The value α measured in the above (9) was used as α.

$$Y = (W_1 \times \alpha/100 + W_2)/W \times 100 \text{ [mass\%]}$$

However, in a case where the disassembled yarns fail to secure the amount of yarns required for the measurement method mentioned above, the result of the test carried out with a maximum length that can be secured and the number of trials can be used as a substitute.

(11) Dry Thermal Shrinkage Ratio

A measurement was performed by the following method using the fluororesin fibers.

The sample was folded in half, and a knot was put to prepare a loop-shaped sample. An initial load (6% load (g) of fineness) was applied to the sample, and the lengths of both ends of the loop-shaped sample were measured. The initial load was removed, and the sample was heat-treated in a dryer at 230° C. for 30 minutes, then taken out, and cooled to room temperature. Thereafter, the initial load was applied again, and lengths of both ends of the looped sample were measured.

The dry thermal shrinkage ratio was calculated by the following formula, and an average value of three times was rounded to one decimal place.

$$\Delta L = (L1 - L2)/L1 \times 100$$

Here, ΔL: dry thermal shrinkage ratio (%), L1: length before heat treatment (mm), L2: length after heat treatment (mm)

Example 1

PTFE fibers ("Toyoflon" (a registered trademark) manufactured by Toray Industries, Inc., the dry thermal shrinkage ratio during heating at 230° C. for 30 minutes: 9%) with a total fineness of 1330 dtex and 180 filaments per single yarn and para-aramid fibers ("Kevlar" (a registered trademark) manufactured by DU PONT-TORAY CO., LTD.) with a total fineness of 880 dtex and 534 filaments per single yarn were doubled and twisted at a twist number of 81 t/m to obtain doubled and twisted yarns, and then a single-layer plain woven fabric was produced by a loom using the doubled and twisted yarns as warp yarns and weft yarns. The warp yarns were not subjected to sizing or the like to enhance weaving properties.

Comparative Example 1

The woven fabric of Example 1 was scoured in a scouring tank at 80° C. for 20 minutes, dried at 130° C. for 2 minutes, and then thermoset at 180° C. for 1 minute.

Example 2

PTFE fibers ("Toyoflon" (a registered trademark) manufactured by Toray Industries, Inc., the dry thermal shrinkage ratio during heating at 230° C. for 30 minutes: 9%) with a total fineness of 440 dtex and 60 filaments per single yarn and para-aramid fibers ("Kevlar" (a registered trademark) manufactured by DU PONT-TORAY CO., LTD.) with a total fineness of 440 dtex and 267 filaments per single yarn were doubled and twisted at a twist number of 167 t/m to obtain doubled and twisted yarns. A double plain woven fabric was produced by a loom using the above-described doubled and twisted yarns as warp yarns and weft yarns of a first surface, and para-aramid fibers with a total fineness of 3300 dtex and 1333 filaments per single yarn ("Kevlar" (a registered trademark) manufactured by DU PONT-TORAY CO., LTD.) are used as warp yarns and weft yarns of a second surface. The warp yarns were not subjected to sizing or the like to enhance weaving properties. Thereafter, the fabric was scoured in a scouring tank at 80° C. for 20 minutes, and dried at 130° C. for 2 minutes.

Example 3

A double plain woven fabric was produced in the same manner as in Example 2 except that para-aramid fibers with a total fineness of 3300 dtex and 1330 filaments per single yarn ("Kevlar" (a registered trademark) manufactured by DU PONT-TORAY CO., LTD.) were used as the weft yarns of the first surface. Thereafter, the double plain woven fabric was scoured in a scouring tank at 80° C. for 20 minutes and dried at 130° C. for 2 minutes.

Comparative Example 2

PTFE fibers with a total fineness of 880 dtex and 120 filaments per single yarn ("Toyoflon" (a registered trademark) manufactured by Toray Industries, Inc., the dry thermal shrinkage ratio during heating at 230° C. for 30 minutes: 9%) and liquid crystal polyester fibers with a total fineness of 850 dtex and 144 filaments per single yarn ("SIVERAS" (a registered trademark) manufactured by Toray Industries, Inc.) were doubled and twisted at a twist number of 167 t/m to obtain the doubled and twisted yarns, and then a 3/1 twill fabric was produced by a loom with the doubled and twisted yarns as the warp yarns, and liquid crystal polyester fibers with a total fineness of 1700 dtex and 288 filaments per single yarn ("SIVERAS" (a registered trademark) manufactured by Toray Industries, Inc.) as the weft yarns. The warp yarns were not subjected to sizing or the like to enhance weaving properties. Thereafter, the fabric was scoured in a scouring tank at 80° C. for 20 minutes, dried at 130° C. for 2 minutes, and thermoset at 180° C. for 1 minute.

Comparative Example 3

PTFE fibers with a total fineness of 440 dtex and 60 filaments per single yarn ("Toyoflon" (a registered trademark) manufactured by Toray Industries, Inc., the dry thermal shrinkage ratio during heating at 230° C. for 30 minutes: 9%) and liquid crystal polyester fibers with a total fineness of 425 dtex and 72 filaments per single yarn ("SIVERAS" (a registered trademark) manufactured by Toray Industries, Inc.) were doubled and twisted at a twist number of 167 t/m to obtain doubled and twisted yarns, and then a single-layer plain woven fabric was produced by a loom with the doubled and twisted yarns as the warp yarns and the weft yarns. The warp yarns were not subjected to sizing or the like to enhance weaving properties. Thereafter, the fabric was scoured in a scouring tank at 80° C. for 20 minutes, dried at 130° C. for 2 minutes, and thermoset at 180° C. for 1 minute.

Comparative Example 4

A single-layer plain woven fabric was produced by a loom with warp yarns made by alternately arranging PTFE fibers ("Toyoflon" (a registered trademark) manufactured by Toray Industries, Inc., the dry thermal shrinkage ratio during heating at 230° C. for 30 minutes: 9%) with a fineness of 440 dtex and 60 filaments per single yarn and liquid crystal polyester fibers ("SIVERAS" (a registered trademark) manufactured by Toray Industries, Inc.) with a fineness of 1700 dtex and 288 filaments per single yarn in a ratio of 2 (yarns): 2 (yarns), and weft yarns made by alternatively arranging PTFE fibers ("Toyoflon" (registered trademark) manufactured by Toray Industries, Inc., the dry thermal shrinkage ratio during heating at 230° C. for 30 minutes: 9%) with a fineness of 2660 dtex and 360 filaments per single yarn and liquid crystal polyester fibers ("SIVERAS" (a registered trademark) manufactured by Toray Industries, Inc.) with a fineness of 425 dtex and 72 filaments per single yarn in a ratio of 2 (yarns): 2 (yarns). The warp yarns were not subjected to sizing or the like to enhance weaving properties. Thereafter, the fabric was scoured in a scouring tank at 80° C., dried at 130° C. for 2 minutes, and thermoset at 200° C. for 1 minute.

Comparative Example 5

A single-layer plain woven fabric was produced by a loom with the warp yarns made by alternately arranging PTFE fibers ("Toyoflon" (a registered trademark) manufactured by Toray Industries, Inc., the dry thermal shrinkage ratio during heating at 230° C. for 30 minutes: 9%) with a fineness of 440 dtex and 60 filaments per single yarn and para-aramid fibers ("Kevlar" (registered trademark) manufactured by DU PONT-TORAY CO., LTD.) with a fineness of 1670 dtex and 1000 filaments per single yarn in a ratio of 2 (yarns): 2 (yarns), and weft yarns made by alternatively arranging PTFE fibers ("Toyoflon" (a registered trademark) manufactured by Toray Industries, Inc., the dry thermal shrinkage ratio during heating at 230° C. for 30 minutes: 9%) with a fineness of 2660 dtex and 360 filaments per single yarn and para-aramid fibers ("Kevlar" (registered trademark) manufactured by DU PONT-TORAY CO., LTD.) with a fineness of 440 dtex and 267 filaments per single yarn in a ratio of 2 (yarns): 2 (yarns). The warp yarns were not subjected to sizing or the like to enhance weaving properties. Thereafter, the fabric was scoured in a scouring tank at 80° C., dried at 130° C. for 2 minutes, and thermoset at 200° C. for 1 minute.

Example 4

The woven fabric described in Example 1 was thermoset at 120° C. for 1 minute.

Example 5

The woven fabric described in Example 1 was thermoset at 140° C. for 1 minute.

Example 6

The woven fabric described in Example 1 was thermoset at 160° C. for 1 minute.

Example 7

The woven fabric described in Example 1 was thermoset at 180° C. for 1 minute.

Example 8

The woven fabric described in Example 1 was scoured in a scouring tank at 80° C. for 1 minute.

Example 9

The woven fabric described in Example 1 was scoured in a scouring tank at 80° C. for 20 minutes.

Example 10

The woven fabric described in Example 1 was scoured in a scouring tank at 60° C. for 20 minutes.

Example 11

A single-layer plain woven fabric was produced in the same manner as in Example 1 except that PTFE fibers ("Toyoflon" (registered trademark) manufactured by Toray Industries, Inc., the dry thermal shrinkage ratio during heating at 230° C. for 30 minutes: 4%) with a total fineness of 1330 dtex and 180 filaments per single yarn were used as fluororesin fibers, and thereafter, the single-layer plain woven fabric was scoured in a scouring tank at 80° C. for 20 minutes, dried at 130° C. for 2 minutes, and then thermoset at 180° C. for 1 minute.

For the woven fabrics described in Examples 1 to 3, Example 11, and Comparative Example 1, evaluation results of configurations of the doubled and twisted yarns, fabric configuration, roughness, thickness reduction rate, kinetic friction coefficient, adhesiveness, and sliding durability distance are summarized in Table 1.

For the woven fabrics described in Comparative Examples 2 to 5, the evaluation results of configuration of the doubled and twisted yarns, fabric configuration, thickness reduction rate, kinetic friction coefficient, adhesiveness, and sliding durability distance are summarized in Table 2.

For the woven fabrics described in Example 1, Comparative Example 1, and Examples 4 to 10, the evaluation results of configuration of the doubled and twisted yarns, fabric configuration, processing details, and roughness are summarized in Table 3.

TABLE 1

| | | | | | Example 1 | Comparative Example 1 | Example 2 | Example 3 | Example 11 |
|---|---|---|---|---|---|---|---|---|---|
| Configuration of doubled and twisted yarns | Fluororesin fibers | | | — | PTFE fibers 1330 dtex | PTFE fibers 1330 dtex | PTFE fibers 440 dtex | PTFE fibers 440 dtex | PTFE fibers 1330 dtex |
| | Para-aramid fibers | | | | Para-aramid fibers 880 dtex | Para-aramid fibers 880 dtex | Para-aramid fibers 440 dtex | Para-aramid fibers 440 dtex | Para-aramid fibers 880 dtex |
| | Mass ratio of fluororesin fibers to doubled and twisted yarns | | | Mass | 60 | 60 | 50 | 50 | 60 |
| Fabric configuration | Weaving structure | | | — | Single-layer plain | Single-layer plain | Double-layer plain | Double-layer plain | Single-layer plain |
| | Yarns used | Warp yarns | First surface | — | Doubled and twisted yarns | Doubled and twisted yarns | Doubled and twisted yarns | Doubled and twisted yarns | Doubled and twisted yarns |
| | | | Second surface | | | | Para-aramid fibers 3300 T | Para-aramid fibers 3300 T | |
| | | Weft yarns | First surface | | Doubled and twisted yarns | Doubled and twisted yarns | Doubled and twisted yarns | Para-aramid fibers 3300 T | Doubled and twisted yarns |
| | | | Second surface | | | | Para-aramid fibers 3300 T | Para-aramid fibers 3300 T | |

TABLE 1-continued

| | | | | | Example 1 | Comparative Example 1 | Example 2 | Example 3 | Example 11 |
|---|---|---|---|---|---|---|---|---|---|
| | Weaving density | Warp yarns | First surface | Yarns/2.54 cm | 31 | 31 | 19 | 19 | 31 |
| | | | Second surface | | | | 19 | 19 | |
| | | Weft yarns | First surface | | 27 | 28 | 17 | 17 | 28 |
| | | | Second surface | | | | 17 | 17 | |
| | Cover factor | | First surface | $dtex^{0.5}$ yarns/2.54 cm | 2505 | 2548 | 958 | 1482 | 2548 |
| | | | Second surface | | | | 2068 | 2068 | — |
| | | | CF1/CF2 | — | — | — | 0.46 | 0.72 | — |
| | Mass ratio of fluororesin fibers to entire woven fabric | | | Mass % | 60 | 60 | 11 | 4 | 60 |
| | Thickness | | | mm | 0.6 | 0.7 | 1.0 | 1.3 | 0.7 |
| Properties | Roughness | | | μm | 409 | 1192 | 851 | 654 | 990 |
| | Thickness reduction rate | | | μm | 74 | 141 | 198 | 116 | 101 |
| | Kinetic friction coefficient | | | — | 0.066 | 0.081 | 0.068 | 0.064 | 0.070 |
| | Adhesiveness | | | $N/mm^2$ | 1.4 | 0.8 | 1.0 | 1.0 | 1.0 |
| | Sliding durability distance | | | m | >150 | >150 | >150 | >150 | >150 |

TABLE 2

| | | | | Comparative Example 2 | Comparative Example 3 | Comparative Example 4 | Comparative Example 5 |
|---|---|---|---|---|---|---|---|
| Configuration of doubled and twisted yarns | | | — | PTFE fibers 880 dtex | PTFE fibers 440 dtex | — | — |
| | | | | Liquid crystal polyester fibers 850 dtex | Liquid crystal polyester fibers 425 dtex | — | — |
| Fabric configuration | Weaving structure | | — | 3/1 twill | Single-layer plain | Single-layer plain | Single-layer plain |
| | Yarns used | Warp yarns | — | Doubled and twisted yarns | Doubled and twisted yarns | (1) and (2) are alternately arranged by 2 yarns (1) PTFE fibers 440 dtex (2) Liquid crystal polyester fibers 1700 dtex | (1) and (2) are alternately arranged by 2 yarns (1) PTFE fibers 440 dtex (2) Para-aramid fibers 1670 dtex |
| | | Weft yarns | | Liquid crystal polyester fibers 1700 dtex | Doubled and twisted yarns | (1) and (2) are alternately arranged by 2 yarns (1) PTFE fibers 2660 dtex (2) Liquid crystal polyester fibers 425 dtex | (1) and (2) are alternately arranged by 2 yarns (1) PTFE fibers 2660 dtex (2) Para-aramid fibers 440 dtex |
| | Weaving density | Warp yarns | Yarns/2.54 cm | 54 | 45 | 38 | 38 |
| | | Weft yarns | Yarns/2.54 cm | 32 | 47 | 36 | 36 |
| | Thickness | | mm | 1.00 | 0.46 | 0.49 | 0.49 |
| Properties | Thickness reduction rate | | μm | 292 | 298 | — | — |
| | Kinetic friction coefficient | | — | 0.087 | 0.088 | 0.073 | 0.091 |
| | Sliding durability distance | | m | 150 | 52 | 29 | 19 |

TABLE 3-1

| | | Example 1 | Comparative Example 1 | Example 4 | Example 5 | Example 6 |
|---|---|---|---|---|---|---|
| Configuration of doubled and twisted yarns | Fluororesin fibers | PTFE fibers 1330 dtex | PTFE fibers 1330 dtex | PTFE fibers 1330 dtex | PTFE fibers 1330 dtex | PTFE fibers 1330 dtex |
| | Para-aramid fibers | Para-aramid fibers 880 dtex | Para-aramid fibers 880 dtex | Para-aramid fibers 880 dtex | Para-aramid fibers 880 dtex | Para-aramid fibers 880 dtex |

TABLE 3-1-continued

| | | | | Example 1 | Comparative Example 1 | Example 4 | Example 5 | Example 6 |
|---|---|---|---|---|---|---|---|---|
| | Mass ratio of fluororesin fibers to doubled and twisted yarns | | Mass % | 60% | 60% | 60% | 60% | 60% |
| Fabric configuration | Weaving structure | | — | Single-layer plain | Single-layer plain | Single-layer plain | Single-layer plain | Single-layer plain |
| | Yarns used | Warp yarns | — | Doubled and twisted yarns | Doubled and twisted yarns | Doubled and twisted yarns | Doubled and twisted yarns | Doubled and twisted yarns |
| | | Weft yarns | — | Doubled and twisted yarns | Doubled and twisted yarns | Doubled and twisted yarns | Doubled and twisted yarns | Doubled and twisted yarns |
| | Weaving density | Warp yarns | Yarns/2.54 cm | 31 | 31 | 31 | 31 | 31 |
| | | Weft yarns | Yarns/2.54 cm | 27 | 28 | 28 | 28 | 28 |
| | Mass ratio of fluororesin fibers to entire woven fabric | | Mass % | 60 | 60 | 60 | 60 | 60 |
| | Thickness | | mm | 0.6 | 0.7 | 0.6 | 0.6 | 0.7 |
| Treatment | Dry thermal treatment | Temperature | ° C. | No treatment | 180 | 120 | 140 | 160 |
| | | Time | min | No treatment | 1 | 1 | 1 | 1 |
| | Wet thermal treatment | Temperature | ° C. | No treatment | 80 | No treatment | No treatment | No treatment |
| | | Time | min | No treatment | 20 | No treatment | No treatment | No treatment |
| Properties | Roughness | | μm | 409 | 1192 | 417 | 615 | 877 |

TABLE 3-2

| | | | | Example 7 | Example 8 | Example 9 | Example 10 |
|---|---|---|---|---|---|---|---|
| Configuration of doubled and twisted yarns | Fluororesin fibers | | | PTFE fibers 1330 dtex | PTFE fibers 1330 dtex | PTFE fibers 1330 dtex | PTFE fibers 1330 dtex |
| | Para-aramid fibers | | | Para-aramid fibers 880 dtex | Para-aramid fibers 880 dtex | Para-aramid fibers 880 dtex | Para-aramid fibers 880 dtex |
| | Mass ratio of fluororesin fibers to doubled and twisted yarns | | Mass % | 60% | 60% | 60% | 60% |
| Fabric configuration | Weaving structure | | — | Single-layer plain | Single-layer plain | Single-layer plain | Single-layer plain |
| | Yarns used | Warp yarns | — | Doubled and twisted yarns | Doubled and twisted yarns | Doubled and twisted yarns | Doubled and twisted yarns |
| | | Weft yarns | — | Doubled and twisted yarns | Doubled and twisted yarns | Doubled and twisted yarns | Doubled and twisted yarns |
| | Weaving density | Warp yarns | Yarns/2.54 cm | 31 | 31 | 31 | 31 |
| | | Weft yarns | Yarns/2.54 cm | 28 | 28 | 28 | 28 |
| | Mass ratio of fluororesin fibers to entire woven fabric | | Mass % | 60 | 60 | 60 | 60 |
| | Thickness | | mm | 0.7 | 0.7 | 0.7 | 0.7 |
| Treatment | Dry thermal treatment | Temperature | ° C. | 180 | No treatment | No treatment | No treatment |
| | | Time | min | 1 | No treatment | No treatment | No treatment |
| | Wet thermal treatment | Temperature | ° C. | No treatment | 80 | 80 | 60 |
| | | Time | min | No treatment | 1 | 20 | 20 |
| Properties | Roughness | | μm | 896 | 784 | 973 | 895 |

The invention claimed is:

1. A sliding material comprising:

a woven fabric being adhered to a base material, the woven fabric comprising doubled and twisted yarns of fluororesin fibers and para-aramid fibers for at least one of warp yarns and weft yarns, and having a roughness of 1150 μm or less on at least one surface where the doubled and twisted yarns are exposed, wherein the sliding material comprises the at least one surface, as a sliding surface, on which the doubled and twisted yarns are exposed and having the roughness of 1150 μm or less.

2. The sliding material according to claim 1, wherein the woven fabric has a thickness of 1.3 mm or less.

3. The sliding material according to claim 1, wherein the warp yarns and the weft yarns include the doubled and twisted yarns.

4. The sliding material according to claim 1, wherein the woven fabric is a multilayer woven fabric including a first surface that is an outermost surface and a second surface that is an outermost surface opposite to the first surface, and at least one of warp yarns and weft yarns of the first surface includes the doubled and twisted yarns.

5. The sliding material according to claim 4, wherein a ratio (CF1/CF2) of a cover factor (CF1) of the first surface to a cover factor (CF2) of the second surface is less than 1.

6. The sliding material according to claim 1, wherein a mass ratio of the fluororesin fibers in the entire woven fabric is 20 mass % or less.

7. The sliding material according to claim 2, wherein the warp yarns and the weft yarns include the doubled and twisted yarns.

8. The sliding material according to claim 2, wherein a mass ratio of the fluororesin fibers in the entire woven fabric is 20 mass % or less.

9. The sliding material according to claim 3, wherein a mass ratio of the fluororesin fibers in the entire woven fabric is 20 mass % or less.

10. The sliding material according to claim 4, wherein a mass ratio of the fluororesin fibers in the entire woven fabric is 20 mass % or less.

11. The sliding material according to claim 5, wherein a mass ratio of the fluororesin fibers in the entire woven fabric is 20 mass % or less.

* * * * *